United States Patent [19]

Hensley

[11] Patent Number: 4,591,151

[45] Date of Patent: May 27, 1986

[54] TORSIONAL EXERCISE DEVICE AND METHOD OF USE

[76] Inventor: Virgil Hensley, 307 Lee Dr., O'Fallon, Ill. 62269

[21] Appl. No.: 715,899

[22] Filed: Mar. 25, 1985

[51] Int. Cl.[4] ..... A63B 21/02

[52] U.S. Cl. ..... 272/140; 272/67; 272/68; 272/DIG. 4

[58] Field of Search ..... 272/125, 126, 131, 132, 272/133, 135, 140, 67, 68, DIG. 4, DIG. 5

[56] References Cited

U.S. PATENT DOCUMENTS

| | | | |
|---|---|---|---|
| 2,818,253 | 12/1957 | Zito | 272/68 |
| 3,132,861 | 5/1964 | Horney | 272/68 |
| 3,396,967 | 8/1968 | Brown | 272/67 |
| 3,666,267 | 5/1972 | McKinney | 272/67 |
| 3,717,338 | 2/1973 | Hughes | 272/67 |
| 3,717,339 | 2/1973 | Holkesvick et al. | 272/133 |
| 3,830,493 | 8/1974 | Miller | 272/67 |
| 3,938,803 | 2/1976 | Wilmoth et al. | 272/67 |
| 4,095,789 | 6/1978 | Mueller | 272/140 |
| 4,155,547 | 5/1979 | Savio et al. | 272/67 |
| 4,193,593 | 3/1980 | Wilson | 272/67 X |

FOREIGN PATENT DOCUMENTS

| | | | |
|---|---|---|---|
| 2107596 | 5/1983 | United Kingdom | 272/67 |

*Primary Examiner*—Richard J. Apley
*Assistant Examiner*—J. L. Welsh
*Attorney, Agent, or Firm*—Edward R. Weber

[57] ABSTRACT

An improved torsional exercise device which allows for a graduated exercise program to build and increase the muscles of the hands, wrists, and forearms through relative rotation of handle grips against a torsion spring of varying tension and which is portable, simple in design, and inexpensive to construct.

8 Claims, 5 Drawing Figures

TORSIONAL EXERCISE DEVICE AND METHOD OF USE

FIELD OF THE INVENTION

The present invention relates to exercise equipment, and more particularly, to hand-held exercise equipment used for the strengthening of the muscles of the hand, the wrist, and the forearm.

BACKGROUND OF THE INVENTION

The fitness craze has brought renewed and increased interest in being physically fit. While equipment which exercises the body and parts thereof is not new, there is continued interest in equipment which is portable, relatively inexpensive, provides for a graduated program to build and increase muscles, and is comprised of a minimal number of parts.

It is therefore among the objects of the invention to provide an improved exercise device which will exercise the muscles involved in palmar flexion and dorsiflexion, i.e., the muscles on the inside of the forearm and the back of the forearm, respectively, the gripping muscles of the hands, and the ligaments and tendons controlling wrist strength. It is also among the objects of the invention to provide a portable, hand-held exercise device made of as few as four parts, although configurations within the scope of the invention may encompass more, which is inexpensive to construct, and which allows for a graduated program to build and increase muscles at the discretion of the exerciser.

SUMMARY OF THE INVENTION

The present invention is constructed and formed of any material which can withstand the pressure received from the grip of an exerciser on the handles thereof and the torque created by the hands and arms of the exerciser as the handle grips are forced against the torsion spring during the exercise program.

In one embodiment, the exercise device of the present invention is comprised of two cylindrical handle grips, which fit together in a sleeve-like arrangement, wherein one handle grip encompasses a portion of the other handle grip, a torsion spring, and a separate pin. In this embodiment, one handle grip is shaped such that the cylindrical handle grip is reduced in size via a shoulder providing a cylindrical shape of smaller diameter having a plurality of holes at one end of the shape used to control the tension of the torsion spring when in use and a notch or hole at the other end of the shape to engage one end of the torsion spring. This smaller cylindrical shape is reduced again via a shoulder to form a spindle which will extend the length of the other handle grip and which will support the torsion spring. The second or other handle grip has a slot approximately three-eighths the circumference of the cylindrical handle grip at the end which encompasses a portion of the first handle grip and a counterbore to engage the free end of the spindle of the first handle grip and a notch or hole at the other end of the handle grip to engage the other end of the torsion spring. A separate pin is then inserted through the slot of the second handle grip and a hole in the first handle grip to hold the desired tension of the torsion spring, the pin extending through the diameter of the smaller cylindrical shape and engaging the slot.

In another embodiment, the exercise device is adapted to have a cylindrical center hub which is reduced in size via a shoulder on each end of the hub, providing two cylindrical shapes of smaller diameter having a plurality of holes adjacent to the center hub, which are used to control the tension of the torsion springs when the device is in use, and a notch or hole at the ends farthest from the center hub to engage the ends of the torsion springs. The smaller cylindrical shapes are reduced further via a shoulder to form spindles which will extend the length of the handle grips which are slipped over the spindles in sleeve-like arrangement and meet the center hub. The handle grips each have a slot approximately three-eighths the circumference of the cylindrical handle grips at the ends which will meet the center hub and a counterbore to engage the free ends of the spindles and a notch or hole to engage the other end of the torsion springs at the ends of the handle grips farthest from the center hub. Separate pins are then inserted through the slots of each handle grip and a hole in the smaller cylindrical shapes on either side of the center hub, extending through the diameter of the smaller cylindrical shapes thereby holding the desired tension in each of the torsion springs.

In use, the person using the exercise device rotates the handle grips relative to each other, the force of that rotation meeting with increasing resistance as the displacement from the normal position of the tension spring increases. The normal position of the torsion spring can be adjusted by engaging the pin with the holes of the cylindrical shape of smaller diameter at increasing degrees of tension, thereby increasing the force needed to displace the torsion spring from the normal position. Additionally the spring can be exchanged for one with increased tension, the exerciser further increasing the tension by locating the engaging pin at the various holes of the cylindrical shape of smaller diameter.

As will be apparent, the present invention is simple in design and thus inexpensive to construct, is portable, and will allow for a graduated program to build and increase muscles.

DETAILED DESCRIPTION OF THE DRAWINGS

Figure 1:
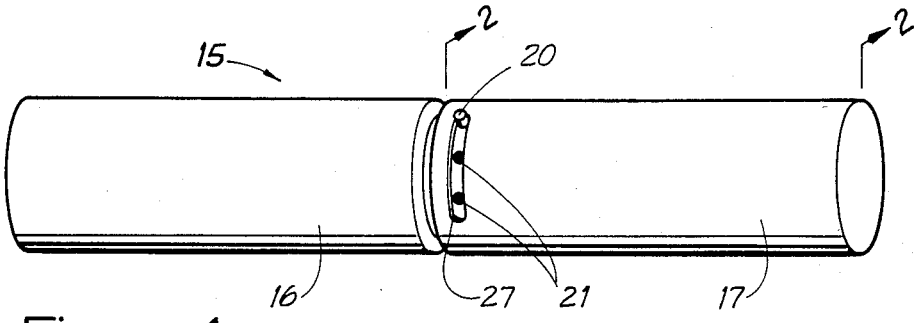
FIG. 1 is a plan view of the exercise device of the present invention in one embodiment.

Referring now to the drawings wherein like reference characters represent like elements, FIG. 1 shows the exercise device 15 in one embodiment, as assembled, with handle grips 16 and 17 and showing separate pin 20 engaging slot 27 to maintain the tension of the torsion spring enclosed within handle grip 17.

Figure 2:
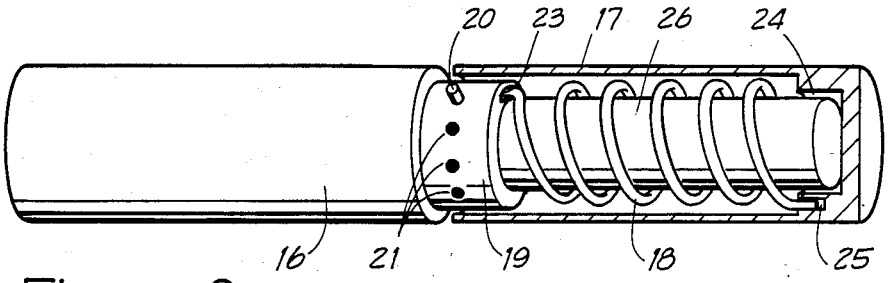
FIG. 2 is a sectional view along the line 2—2 of FIG. 1.

FIG. 2 shows a sectional view of the assembled device wherein the handle grip 16 reduces via a shoulder to form cylindrical shape 19 which is of smaller diameter. Cylindrical shape 19 has a plurality of holes 21 near one end of the shape, which are used to control the tension of torsion spring 18. Separate pin 20 is inserted through slot 27 of handle grip 17 and one of the plurality of holes 21 of cylindrical shape 19 to maintain that tension, pin 20 extending through the diameter of cylindrical shape 19. A notch 23 is located at the end of cylindrical shape 19 and engages one end of torsion spring 18. Cylindrical shape 19 further reduces via a shoulder to form spindle 26, which is coaxially surrounded by torsion spring 18. Handle grip 17 is in sleeve-like arrangement with cylindrical shape 19, spindle 26, and torsion spring 18. The end of handle grip 17 adjacent to handle grip 16 has a slot 27 which is aligned with the plurality of holes 21 of cylindrical shape 19 and which allows the insertion of separate pin 20 into one of the plurality of holes 21. A counterbore 24 which engages the free end of spindle 26 to offer support thereof is located at the end of handle grip 17 opposite handle grip 16. Notch 25 which engages the other end of torsion spring 18 is located close to counterbore 24 of handle grip 17.

Figure 3:
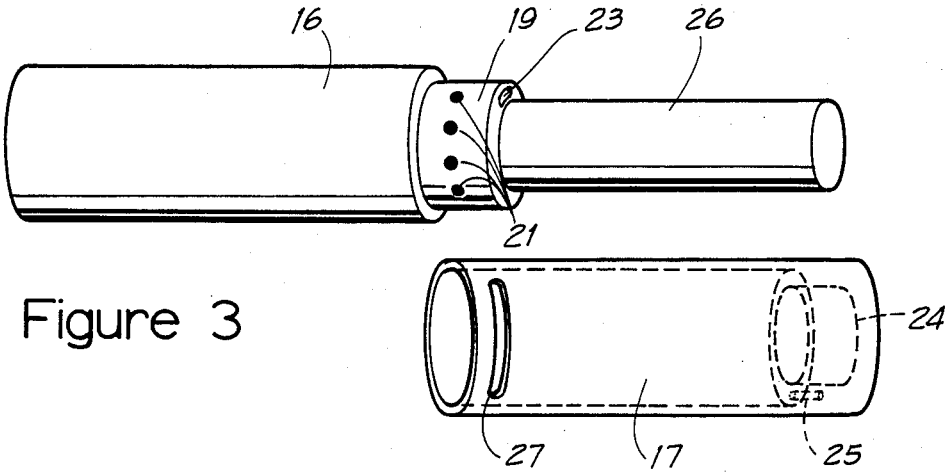
FIG. 3 shows the two main pieces of the exercise device, i.e., the handle grips, unassembled.

FIG. 3 illustrates more clearly the main pieces of exercise device 15 in an unassembled state. Handle grip 16 is seen to reduce via a shoulder to cylindrical shape 19 of smaller diameter. The end of cylindrical shape 19 adjacent to handle grip 16 has a plurality of holes 21 through which a separate pin may be inserted to maintain the tension of a torsion spring. Notch 23 is located at the opposite end of cylindrical shape 19 and engages one end of the torsion spring. Cylindrical shape 19 further reduces via a shoulder to form spindle 26. Handle grip 17 has a slot 27 approximately three-eighths the circumference of handle grip 17 at the end which will be adjacent to handle grip 16 when the device is in sleeve-like arrangement with cylindrical shape 19 and spindle 26. Counterbore 24, which will engage the free end of the spindle when the device is assembled, and notch 25, which will engage one end of a torsion spring when assembled, are located at the end of handle grip 17 opposite slot 27.

Figure 4:
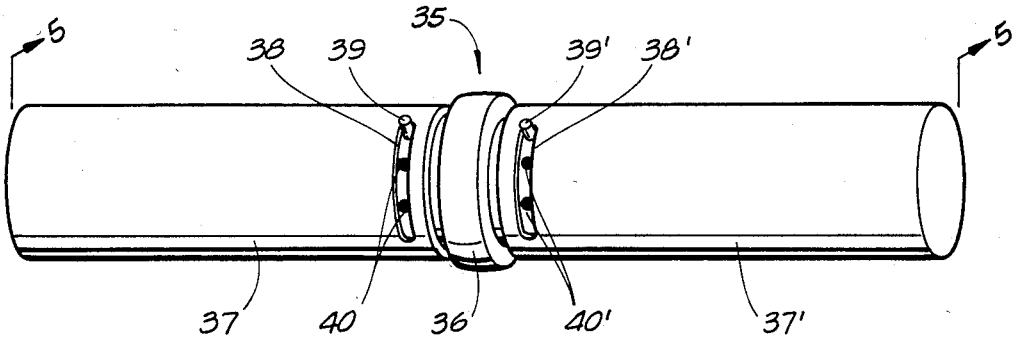
FIG. 4 is a plan view of the exercise device of the present invention in another embodiment.

FIG. 4 shows the exercise device 35 in another embodiment, as assembled, with center hub 36 and handle grips 37 and 37' and showing separate pins 39 and 39' engaging slots 38 and 38' to maintain the tension of paired torsion springs enclosed within handle grips 37 and 37'.

Figure 5:
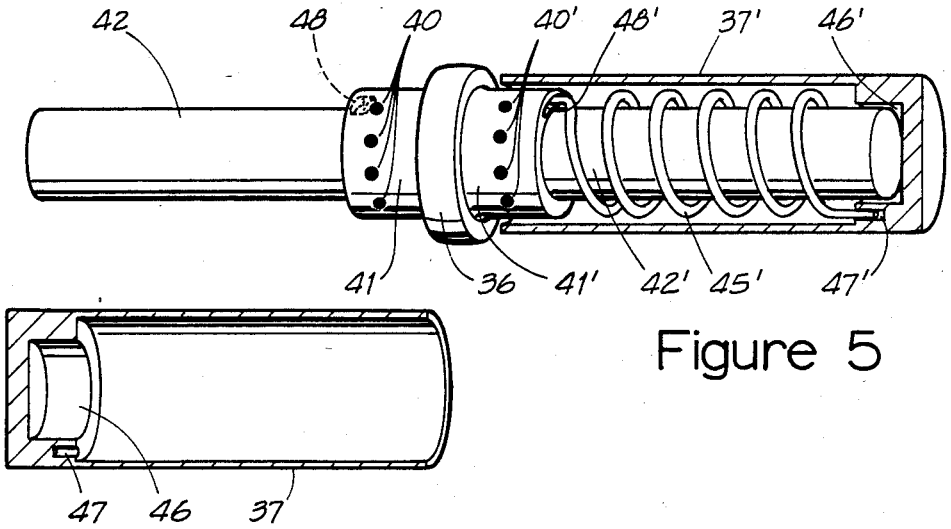
FIG. 5 is a sectional view along the line 5—5 of FIG. 4.

FIG. 5 shows both a sectional view of a partly assembled device 35 and a clearer representation of the main pieces of exercise device 35 in an unassembled state. In this embodiment, center hub 36 reduces via a shoulder on each side to cylindrical shapes 41 and 41' of smaller diameter. Cylindrical shapes 41 and 41' have a plurality of holes 40 and 40' near the end of shapes 41 and 41', respectively, adjacent to center hub 36. Notches 48 and 48' are on the end of cylindrical shapes 41 and 41', respectively, farthest from center hub 36. As seen in the sectional view, notch 48' engages the end of torsion spring 45'. Separate pin 39', as seen in the sectional view, is inserted through slot 38' and into one of the plurality of holes 40' to maintain a desired tension of torsion spring 45', the pin 39' extending through the diameter of cylindrical shape 41'. Cylindrical shapes 41 and 41' further reduce via a shoulder to form spindles 42 and 42'. Torsion spring 45', as seen in the sectional view, coaxially surrounds spindle 42'. Handle grip 37', as seen in the sectional view, is in sleeve-like arrangement with cylindrical shape 41', spindle 42', and torsion spring 45'. The end of handle grip 37' which is adjacent to center hub 36 in its assembled state has a slot 38' approximately three-eighths the circumference of handle grip 37' which is aligned with the plurality of holes 40' of cylindrical shape 41' and which allows separate pin 39' to be inserted into one of the plurality of holes 40'. At the end of handle grip 37' opposite slot 38' is counterbore 46', which engages the free end of spindle 42' for support thereof. Notch 47', which engages an end of torsion spring 45', is located closed to counterbore 46' of handle grip 37'.

The clearer representation of the main pieces of exercise device 35 shows the device in an unassembled state wherein the reduction of center hub 36 via shoulders to cylindrical shape 41 of smaller diameter and to spindle 42 can be readily seen. The plurality of holes 40 are seen to be adjacent to center hub 36, while notch 48, which engages the torsion spring, is opposite the plurality of holes 40 of cylindrical shape 41. Handle grip 37, which fits in sleeve-like relation to cylindrical shape 41 and spindle 42, when assembled, has a slot 38 which is approximately three-eighths the circumference of handle grip 37 at the end of handle grip 37 which lies adjacent to center hub 36. Opposite slot 38, handle grip 37 has a counterbore 46, which engages the free end of spindle 42 and offers support therefor, and a notch 47, which engages an end of the torsion spring, when assembled.

In operation, handle grips 16 and 17 of exercise device 15 are rotated relative to each other. As this rotation increases, the person using the device meets the tension held by separate pin 20 of torsion spring 18. Exercise involving the muscles used in palmar flexion and dorsiflexion, the gripping muscles of the hand, and the ligaments and tendons controlling wrist strength is received as the displacement of the torsion spring 18 increases from its normal position due to the rotation of handle grips 16 and 17.

In the other embodiment, handle grips 37 and 37' are rotated relative to each other around center hub 36. As the rotation increases, the person using the exercise device meets the tension maintained by separate pins 39 and 39' of the paired torsion springs. Exercise is obtained as displacement from the normal position of the tension springs increases due to the rotation of handle grips 37 and 37'.

Although the present invention has been described and illustrated with respect to two embodiments thereof, it is to be understood that it is not to be so limited since changes and modifications may be made therein which are within the full intended scope of this invention as hereinafter claimed.

What is claimed is:

1. An exercise device comprising a pair of cylindrical handle grips wherein the first cylindrical handle grip is reduced via a shoulder to form a cylindrical shape of smaller diameter, said cylindrical shape having a plurality of holes in the circumference thereof and adjacent to the handle grip; said cylindrical shape further reducing via a second shoulder to form a cylindrical spindle; a torsion spring coaxially surrounding said spindle and having one end engaged in a notch or hole in said second shoulder adjacent to the cylindrical spindle; said second cylindrical handle grip being assembled coaxially in sleeve-like relation surrounding the cylindrical shape and cylindrical spindle of said first handle grip and having a slot partially extending around the circumference of said second handle grip near the end of said second handle grip surrounding said cylindrical shape of said first handle grip and in alignment with the plurality of holes in said cylindrical shape; a counterbore and a notch or hole at the end of said second handle grip opposite said slot; said counterbore engaging the free end of said cylindrical spindle in support thereof and said notch or hole engaging the second end of said torsion spring; and a torsional adjustment means comprising a separate pin being of a length approximating the diameter of the second cylindrical handle grip and of a diameter approximating the diameter of said plurality of holes in the cylindrical shape of the first cylindrical handle grip, said separate pin serving to hold said first and said second cylindrical handles in assembled condition, to maintain a desired tension in said torsion spring, and further permitting the second cylindrical handle grip to rotate with respect to said first cylindrical handle grip.

2. An exercise device according to claim 1 wherein the handle grips are constructed from plastic, wood, or metal.

3. An exercise device comprising a cylindrical center hub and a pair of cylindrical handle grips wherein the cylindrical center hub reduces via a shoulder on each side to form two cylindrical shapes of smaller diameter, said cylindrical shapes each having a plurality of holes in the circumference thereof adjacent to said cylindrical center hub; said cylindrical shapes each further reducing via a second shoulder to form cylindrical spindles; a torsion spring coaxially surrounding each of said spindles, each spring having one end engaged in a notch or hole in said second shoulder adjacent to each of said cylindrical spindles; said pair of cylindrical handles grips being assembled coaxially in sleeve-like relation surrounding said second cylindrical shapes and said cylindrical spindles and each having a slot partially extending around the circumference of said pair of cylindrical handle grips near the end of said pair of cylindrical handle grips surrounding said cylindrical shapes and adjacent to said cylindrical center hub and in alignment with the plurality of holes in said cylindrical shapes, and each cylindrical handle grip having a counterbore and a notch or hole at the end of said cylindrical handle grips opposite said slots; said counterbores engaging the free ends of said cylindrical spindles in support thereof and said notch or hole engaging the second ends of said paired torsion springs; and a torsional adjustment means comprising two separate pins, each pin being of a length approximating the diameter of said cylindrical handle grips and of a diameter approximating the diameter of said plurality of holes in the two cylindrical shapes adjacent to said cylindrical center hub; said separate pins serving to hold said pair of cylindrical handle grips in assembled condition with said cylindrical center hub, to maintain a desired tension in each of said torsion springs and further permitting each of said cylindrical handle grips to rotate relative to each other and to said cylindrical center hub.

4. An exercise device according to claim 3 wherein the handle grips and center hub are constructed from plastic, wood, or metal.

5. An exercise device according to claim 1 wherein a plurality of torsion springs of varying degrees of tension can be used and interchanged at the discretion of the individual using said device to provide a variation in the force needed to rotate the second cylindrical handle grip in relationship to said first cylindrical handle grip.

6. An exercise device according to claim 3 wherein a plurality of torsion springs of varying degrees of tension can be used and interchanged at the discretion of the individual using said device to provide a variation in the force needed to rotate said first and said second cylindrical handle grips in relationship to each other and to said cylindrical center hub.

7. A method of exercising utilizing the device of claim 1 wherein the cylindrical handles grips are rotated relative to each other, the force of said rotation meeting with increasing resistance as the displacement from the normal position of the torsion spring increases; said normal position being adjustable by engaging said separate pin into one of the plurality of holes in said exercise device thereby changing the degree of tension of said torsion spring and increasing the force needed to rotate the first cylindrical handle grip with respect to said second cylindrical handle grip.

8. A method of exercising utilizing the device of claim 3 wherein the cylindrical handle grips are rotated relative to each other, the force of said rotation meeting with increasing resistance as the displacement from the normal position of the pair of torsion springs increase; said normal position being adjustable by engaging said separate pins into one of the plurality of holes on each side of said cylindrical center hub of said exercise device thereby changing the degree of tension of said torsion springs and increasing the force needed to rotate said first cylindrical handle grip with respect to said second cylindrical handle grip and to said cylindrical center hub.

* * * * *